United States Patent [19]

Arano et al.

[11] Patent Number: 4,793,298

[45] Date of Patent: Dec. 27, 1988

[54] VENTILATOR FOR IGNITION DISTRIBUTOR

[75] Inventors: Isamu Arano; Takashi Kokubun, both of Katsuta, Japan

[73] Assignee: Hitachi, Ltd., Tokyo, Japan

[21] Appl. No.: 94,604

[22] Filed: Sep. 9, 1987

[30] Foreign Application Priority Data

Sep. 16, 1986 [JP] Japan ..... 61-215795

[51] Int. Cl.[4] ..... F02P 7/02

[52] U.S. Cl. ..... 123/146.5 A; 200/19 R

[58] Field of Search ..... 123/146.5 A; 200/19 DR, 200/19 DC, 306, 19 R

[56] References Cited

U.S. PATENT DOCUMENTS 1,813,808 7/1931 Koehn ..... 200/19 R X
2,207,368 7/1940 Arthur ..... 123/146.5 A
4,545,340 10/1985 Schreiner ..... 200/19 DR
4,627,393 12/1986 Takenaka ..... 200/19 R X
4,661,661 4/1987 Kronberger ..... 200/19 R

FOREIGN PATENT DOCUMENTS 61-4869 10/1986 Japan ..... 123/146.5 A

*Primary Examiner*—Tony M. Argenbright
*Attorney, Agent, or Firm*—Antonelli, Terry & Wands

[57] ABSTRACT

A ventilator for an ignition distributor used with an automobile comprises an air intake passage for sucking air from the outside of the distributor and an air exhaust passage for exhausting the air to the outside of the distributor. Each passage has one end opening in the upper surface of the bottom of the distributor, and the other end opening in the outer surface of the distributor. These openings of each passage are connected to each other through a passage bent at an obtuse angle or a passage having an intermediate bent passage portion formed in a circular arc shape.

7 Claims, 3 Drawing Sheets

VENTILATOR FOR IGNITION DISTRIBUTOR

BACKGROUND OF THE INVENTION

The present invention relates to a ventilator for an ignition distributor used with an internal combustion engine for an automobile, and particularly to a ventilator for an ignition distributor which has improved ventilation properties.

In general, large amounts of ozone and nitrogen oxides are produced in an ignition distributor of an automobile by the spark discharge generated between a fixed electrode which is provided on a distribution cap and a distribution rotor which rotates together with the rotation of the engine. When these substances react with water, nitric acid is produced. The ozone and nitric acid corrode the components of the distributor, and thus hinder the working of the distributor.

Therefore, a technique, for instance, as disclosed in Japanese Patent Laid-Open No. 4869/1986 is known as a structure for ventilating a distributor, in which ventilation is provided by means of a plurality of holes communicating the inside of a distributor with the outside thereof in order to exhaust the internal air which contains harmful gases and which is rotated by the rotor in the distributor.

The above-described conventional communicating holes have disadvantages i that, since an internal opening portion of each communicating hole is formed substantially at right angles to an external opening portion thereof and the ventilation resistance of air is therefore large, the ventilation efficiency is decreased, the flow of air is discontinuous, and the dust passing into the communicating holes stays at the bends therein.

SUMMARY OF THE INVENTION

The present invention has been achieved in consideration of the above-described situation, and it is a primary object of the invention to provide a ventilator for an ignition distributor which exhibits a small ventilation resistance and a good ventilation efficiency, and which as no danger of air holes becoming clogged with dust.

In order to attain the above-described object, according to the first aspect of the invention, provided is a ventilator for an ignition distributor in which a plurality of bent air holes are formed in a housing of the distributor and the interior of the distributor is ventilated by utilizing the rotation of air caused therein by the rotation of a distribution rotor, characterized in that the angle of bend of each bent air hole is an obtuse angle.

Additionally, in order to attain the same object, according to the second aspect of the invention, there is provided a ventilator for an ignition distributor in which a plurality of bent air holes are formed in a housing of the distributor and the interior of the distributor is ventilated by utilizing the rotation of air caused therein by the rotation of a distribution rotor, characterized in that a bend portion of each bent air hole is formed in a circular arc shape.

The above-described configuration of each bent air hole comprising either a bend at an obtuse angle or a circular arc reduces the ventilation resistance, of air, improves the ventilation efficiency of the ventilator, and prevents the air hole from being clogged with dust.

Additionally, when the present invention is put into practice, among the plurality of air holes, the cross-sectional area of each ventilation inlet port may be set to be larger than that of each ventilation exhaust port, so that air drawn for ventilation is reduced in flow speed, and thus dust is not easily inhaled.

BRIEF DESCRIPTION OF THE DRAWINGS

FIG. 1 is a sectional view of the same, FIG. 2 is a perspective view illustrating communicating holes thereof, and FIG. 3 is a sectional view of one of the holes;

DETAILED DESCRIPTION OF EMBODIMENTS

Figure 1:
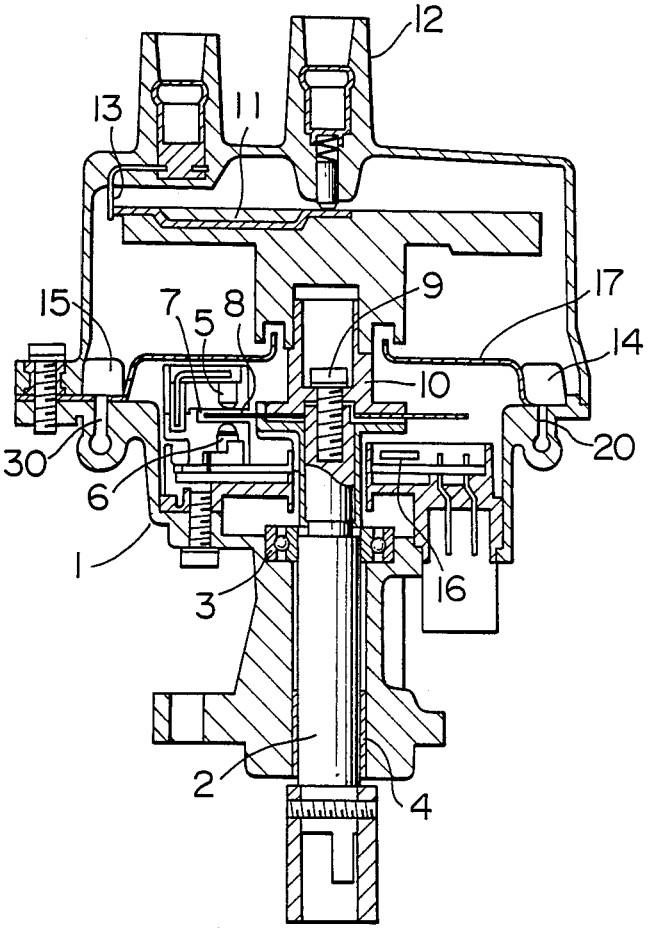
FIGS. 1 to 3 show an embodiment according to the first aspect of the invention, where
Figure 2:
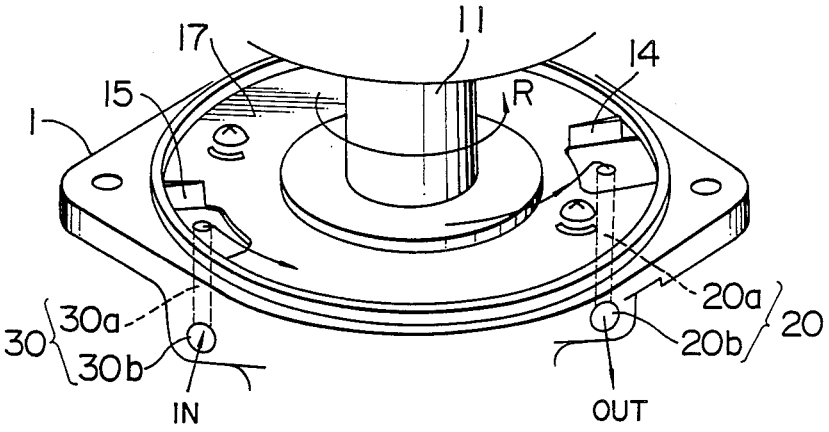
Figure 3:
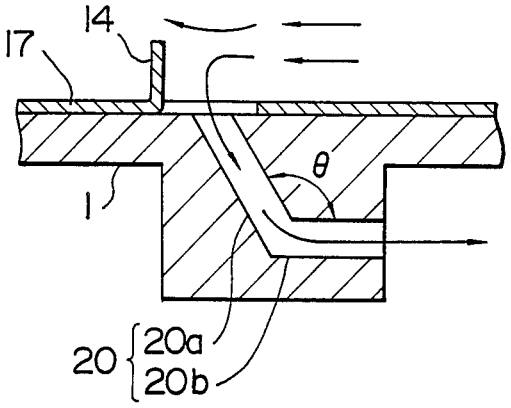

FIGS. 1 to 3 show an embodiment according to the first aspect of the invention, where FIG. 1 is a sectional view of a distributor, FIG. 2 is an explanatory view of communicating holes of the distributor, and FIG. 3 is a sectional view of one of the holes.

In FIG. 1, reference numeral 1 denotes a cup-shaped housing which serves as a distributor body and is made through an aluminum die casting, and bearings 3 and 4 are provided in the housing so as to removably support a shaft 2.

Reference numeral 5 denotes a light-emitting diode, and reference numeral 6 denotes a light-receiving diode. A rotor plate 8 which has a plurality of slits formed therein is provided in a gap 7 between the two diodes and is fixedly clamped between a rotor shaft 10 and the shaft 2 by means of a screw 9. A distribution rotor 11 is fitted to the upper portion of the rotor shaft 10.

The distribution rotor 11 is so constructed as to be electrically connected through a gap to a side electrode 13 provided on a cap 12. Holes 20, 30 for communicating the inside of the distributor with the outside thereof are provided in the housing 1.

The communicating hole 20 is a hole for exhaust or air outlet and opens on the upstream side of a baffle plate 14 with respect to the direction of rotation, of the rotor, as shown in FIG. 2.

On the other hand, the communicating hole 30 is a hole for suction or air inlet and is located on the downstream side of a baffle plate 15.

The air containing ozone and nitrogen oxides in the distributor is rotated in a direction as the distribution rotor 11 rotates, which direction is denoted by an arrow R and is the same as the direction of rotation of the rotor, and strikes the baffle plates so that a negative pressure is produced on the downstream sides of the baffle plates and a positive pressure is produce on the upstream sides thereof.

Accordingly, the atmosphere is drawn from the communicating hole 30, as shown by arrows IN, and the air in the distributor is exhausted through the communicating hole 20 into the atmosphere as shown by arrows OUT.

Reference numerals 20*a*, 30*a* each denote a communicating passage of the communicating hole on the distributor side and reference numerals 20*b*, 30*b* each denote a communicating passage of the communicating hole on the atmosphere side.

FIG. 3 is a sectional view of the communicating hole 20 for exhaust. The communicating hole 30 for suction has a similar configuration. When the shaft 2 is rotated in synchronism with an engine, the rotor plate 8, which is integral with the shaft 2, is rotated in the gap 7 between the light-emitting diode 5 and the light-receiving diode 6, and electrical signals for detecting, for instance, the number of revolutions of the engine, the piston position of the engine and the like are formed in a control circuit unit 16 by the passage of the plurality of slits provided around the periphery of the rotor plate 8 between the diodes. These electrical signals are input into a control unit (not shown), which comprises a microcomputer, so as to generate a high secondary voltage in a ignition coil (not shown) and produce a discharge from the distribution rotor 11 to the side electrode 13. Thus, electricity is supplied to a spark plug (not shown) to ignite an air-fuel mixture in a cylinder of the engine.

The discharge between the distribution rotor 11 and the side electrode 13 requires the provision of a shield cover 17 above the control circuit unit 16.

In the embodiment having the structure described above, large amounts of ozone and nitrogen oxides are generated during operation by the discharge between the distribution rotor 11 and the side electrode 13 and, when these substances react with water, nitric acid is produced. The ozone and nitric acid will corrode the components in the distributor and hinder the operation thereof, unless the distributor is ventilated. According the above embodiment, however, ventilation is provided by the communicating hole 30 for suction and the communicating hole 20 for exhaust, as described with reference to FIG. 2. The resistance of air of this ventilation is small and dust does not readily stay in the bend of each communicating hole, because the angle $\theta$ of bend of each communication hole is an obtuse angle as illustrated in the case of the communicating hole 20 in FIG. 3.

Figure 4:
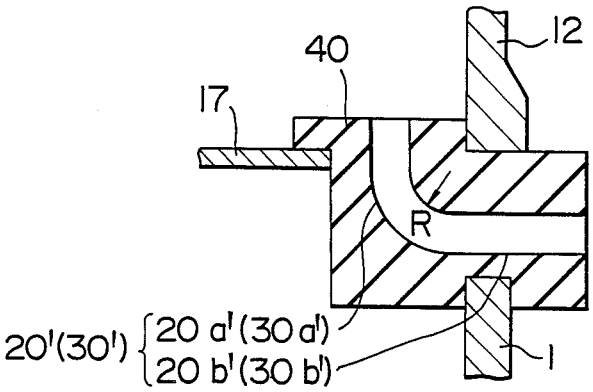
FIG. 4 is a sectional view of a communicating passage in an embodiment according to the second aspect of the invention.

FIG. 4 shows an embodiment according to the second aspect of the invention, and is a sectional view corresponding to FIG. 3 of the first embodiment. In this embodiment, each communicating holes 20' or 30' is formed through a rubber grommet 40 which is fitted between the cap 12 and the shied cover 17 of the distributor.

The communicating hole 20' (30') of this embodiment comprises a communicating passage 20*a'* (30*a'*) on the distributor side and a communicating passage 20*b'* (30*b'*) on the atmosphere side which are connected to each other by means of a passage bent in a circular arc form with a radius of curvature R. The communication holes of this configuration can achieve a function and effect which is similar to that of the first embodiment.

Figure 5:
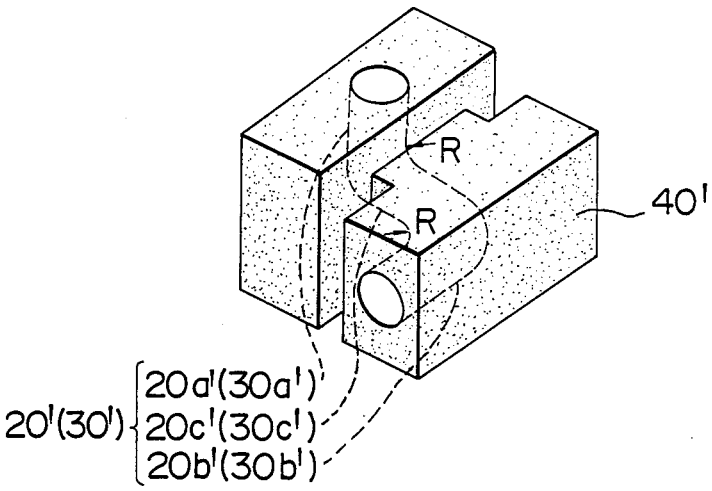
FIG. 5 is a perspective view illustrating a communicating passage in another embodiment according to the second aspect of the invention.

FIG. 5 shows another embodiment according to the second aspect of the invention, which differs from the embodiment of FIG. 4.

In this embodiment, two bent portions or passages each in the form of a circular arc are provided in a grommet 40', and each communicating hole has an intermediate communicating passage 20*c'* (30*c'*) provided between a communicating passage 20*a'* (30*a'*) on the distributor side and a communicating passage 20*b'* (30*b'*) on the atmosphere side. The communicating hole 20' and 30' of this configuration also can achieve a function and effect which is the same as that of the above-described embodiment shown in FIG. 4. Additionally, the present invention can be applied also to a distributor in which a fan is provided on the lower side of a rotor 11 to ensure that an air flow is positively generated in the distributor.

As described above, a distributor to which the present invention is applied exhibits excellent practical effects in that it has a good ventilation efficiency and there is no danger of it becoming clogged with dust.

What is claimed is:

1. A ventilator for an ignition distributor in which a plurality of bent air holes are provided in a housing of the distributor and ventilation of the distributor is performed by utilizing rotation of air in the distributor caused by rotation of a distribution rotor wherein the improvement comprises an angle of bend of each of said bent air holes being an obtuse angle and among said plurality of air holes, a cross-sectional area of a each ventilation intake port is larger than that of each ventilation exhaust port.

2. A ventilator for an ignition distributor in which a plurality of bent air holes are provided in a housing of the distributor and ventilation of the distributor is performed by utilizing rotation of air in the distributor caused by rotation of a distribution rotor, wherein the improvement comprises a bent portion of each of said bent air holes formed in a circular arc shape, and among said plurality of air holes, a cross-sectional area of each ventilation intake port is larger than that of each ventilation exhaust port.

3. A ventilator for an ignition distributor comprising:

(a) air intake passage means and air exhaust passage mean each having one end opening in an upper surface of a bottom wall of said distributor and another end opening in an outer surface of said distributor, said two openings of each means being connected to each other through one of a passage bent at an obtuse angle and an intermediate passage bent in a circular arc shape; and (b) at least one pair of baffle plate means, one of which being provided in a vicinity of and in a position upstream of said opening of said air intake passage means in the upper surface of the bottom wall of said distributor with respect to a rotating air flow caused in said distributor by rotation of a rotor, and another of which being provided in a vicinity of and in a position downstream of said opening of said air exhaust passage means in tee upper surface of the bottom wall of said distributor with respect to the rotating air flow generated by the rotation of the rotor.

4. A ventilator as claimed in claim 3, wherein said air intake passage means and said air exhaust passage means are formed in rubber grommets which are fitted in notches provided in a housing of said distributor, respectively.

5. A ventilator as claimed in claim 3, wherein said baffle plate means comprises a plate member formed by cutting and raising a portion of a shield cover which is fitted to the bottom wall of said distributor so as to cover an upper portion of said bottom wall of said distributor.

6. A ventilator as claimed in claim 4, wherein said baffle plate means comprises a plate member formed by cutting and raising a portion of a shield cover which is fitted to the bottom wall of said distributor so as to cover an upper portion of said bottom wall of said distributor.

7. A ventilator for an ignition distributor with a housing having a plurality of bent air holes provided in the housing, each of said bent air holes having a bend at an obtuse angle and a bend in a circular arc shape, wherein a cross-sectional area of each of said holes for ventilation intake is larger than a cross-sectional area of each of said holes for ventilation exhaust.

* * * * *